US011812818B2

(12) United States Patent
Schneider

(10) Patent No.: US 11,812,818 B2
(45) Date of Patent: Nov. 14, 2023

(54) FOOTWEAR AIRBAG WITH FLEXIBLE ELECTRONIC INTERCONNECT

(71) Applicant: NIKE, Inc., Beaverton, OR (US)

(72) Inventor: Summer L. Schneider, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 99 days.

(21) Appl. No.: 17/333,228

(22) Filed: May 28, 2021

(65) Prior Publication Data

US 2021/0368925 A1 Dec. 2, 2021

Related U.S. Application Data

(60) Provisional application No. 63/032,096, filed on May 29, 2020.

(51) Int. Cl.

| | |
|---|---|
| ***A43B 13/20*** | (2006.01) |
| ***A43B 13/02*** | (2022.01) |
| ***A43B 3/34*** | (2022.01) |

(52) U.S. Cl.

CPC ..... *A43B 13/20* (2013.01); *A43B 3/34* (2022.01); *A43B 13/023* (2013.01)

(58) Field of Classification Search

CPC ..... A43B 13/20; A43B 3/34; A43B 13/023
USPC ..... 36/29
See application file for complete search history.

(56) References Cited

U.S. PATENT DOCUMENTS

| | | | |
|---|---|---|---|
| 5,802,739 A | 9/1998 | Potter et al. | |
| 6,402,879 B1 | 6/2002 | Tawney et al. | |
| 7,171,331 B2 * | 1/2007 | Vock | G01B 21/00 702/160 |
| 8,479,412 B2 | 7/2013 | Peyton et al. | |
| 8,764,931 B2 | 7/2014 | Turner | |
| 9,597,497 B2 | 3/2017 | Swain et al. | |

(Continued)

FOREIGN PATENT DOCUMENTS

| | | |
|---|---|---|
| CN | 105380342 | 3/2016 |
| CN | 105831880 | 8/2016 |

(Continued)

OTHER PUBLICATIONS

"International Application Serial No. PCT US2021 034731, International Preliminary Report on Patentability dated Dec. 8, 2022", 6 pgs.

(Continued)

*Primary Examiner* — Timothy K Trieu
(74) *Attorney, Agent, or Firm* — Schwegman, Lundberg & Woessner, P.A.

(57) ABSTRACT

Articles of footwear, systems, and methods include an upper portion, a lower portion, secured to the upper portion, the lower portion including an out-sole and an airbag assembly. The airbag assembly includes a first sheet and a second sheet forming a seal therebetween around a perimeter of the first and second sheets. The airbag assembly further includes an electronic assembly, comprising a circuit board and electrical conductors disposed on the circuit board, wherein an internal portion of the electronic assembly is disposed between the first and second sheets and within the seal formed therebetween and an external portion of the electronic assembly is disposed outside of the seal.

6 Claims, 10 Drawing Sheets

(56) References Cited

U.S. PATENT DOCUMENTS

| | | | | |
|---|---|---|---|---|
| 2003/0231513 | A1* | 12/2003 | Wei | A43B 3/36 362/570 |
| 2007/0147026 | A1* | 6/2007 | Tseng | A43B 3/36 362/276 |
| 2011/0192053 | A1* | 8/2011 | Beers | A43B 13/20 36/137 |
| 2017/0265587 | A1 | 9/2017 | Walker et al. | |
| 2018/0199674 | A1 | 7/2018 | Walker et al. | |
| 2018/0256071 | A1* | 9/2018 | Mathieu | G01L 1/146 |
| 2019/0365043 | A1 | 12/2019 | Hazenberg et al. | |
| 2020/0022653 | A1 | 1/2020 | Moisa | |
| 2020/0260819 | A1 | 8/2020 | Case et al. | |

FOREIGN PATENT DOCUMENTS

| | | |
|---|---|---|
| CN | 110200350 | 9/2019 |
| WO | 2021243134 | 12/2021 |

OTHER PUBLICATIONS

"International Application Serial No. PCT US2021 034731, International Search Report dated Sep. 14, 2021", 5 pgs.
"International Application Serial No. PCT US2021 034731, Written Opinion dated Sep. 14, 2021", 4 pgs.

* cited by examiner

FOOTWEAR AIRBAG WITH FLEXIBLE ELECTRONIC INTERCONNECT

PRIORITY APPLICATIONS

This application claims the benefit of priority to U.S. Provisional Patent Application Ser. No. 63/032,096, filed May 29, 2020, the content of which is incorporated herein by reference in its entirety.

TECHNICAL FIELD

The subject matter disclosed herein generally relates to an article of footwear having an airbag with a flexible electronic interconnect.

BRIEF DESCRIPTION OF THE DRAWINGS

Some embodiments are illustrated by way of example and not limitation in the figures of the accompanying drawings.

DETAILED DESCRIPTION

Figure 1:
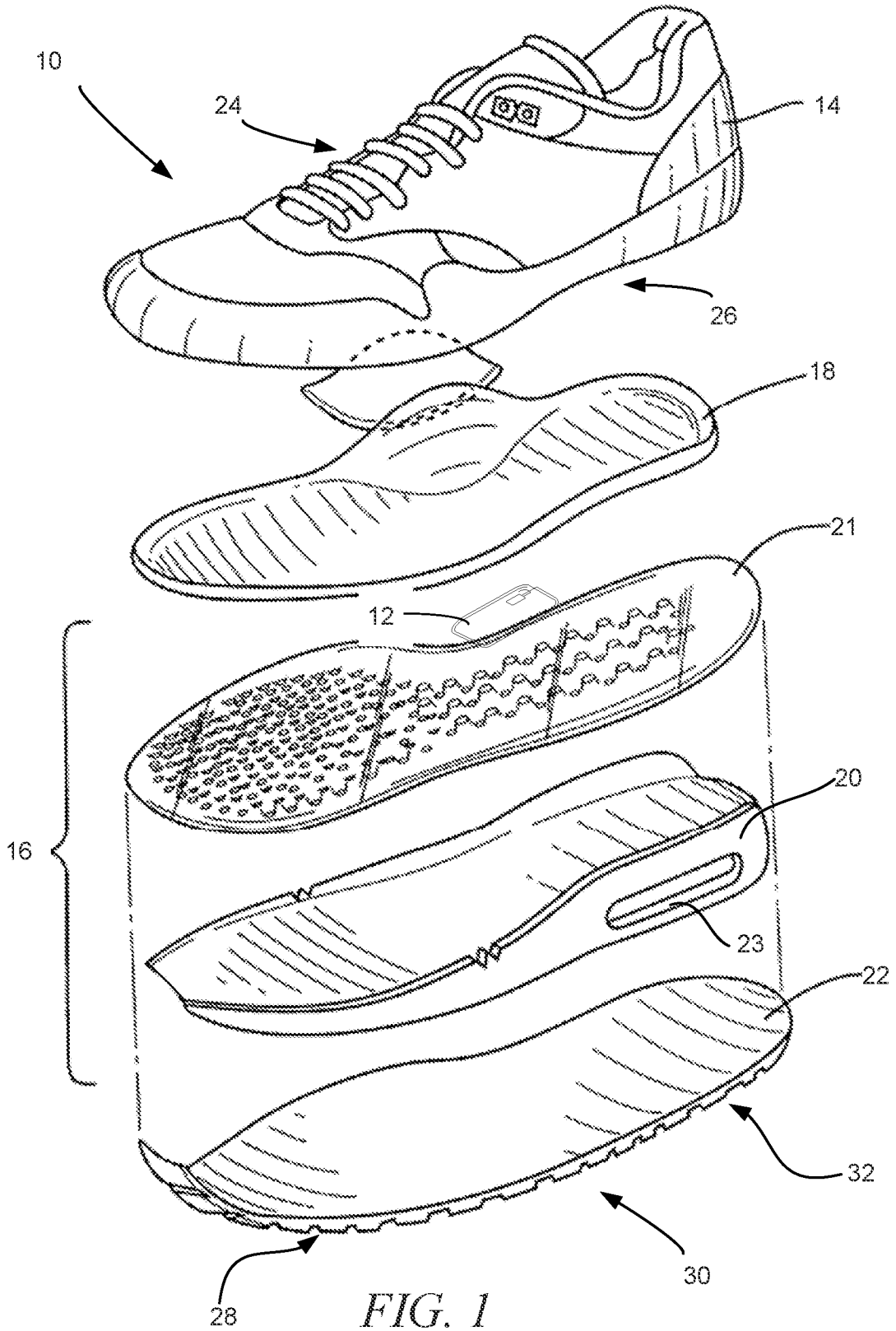
FIG. 1 is an exploded perspective view of an article of footwear incorporating a flexible electronic assembly, in an example embodiment.

Example methods and systems are directed to an article of footwear having an airbag with a flexible electronic interconnect. Examples merely typify possible variations. Unless explicitly stated otherwise, components and functions are optional and may be combined or subdivided, and operations may vary in sequence or be combined or subdivided. In the following description, for purposes of explanation, numerous specific details are set forth to provide a thorough understanding of example embodiments. It will be evident to one skilled in the art, however, that the present subject matter may be practiced without these specific details.

Articles of footwear, such as shoes, may include a variety of components, both conventional and unconventional. Conventional components may include an upper, a sole, and laces or other securing mechanisms to enclose and secure the foot of a wearer within the article of footwear. The sole may include an airbag or cushioning system. Unconventionally, electronics may be included to provide for sensors, wireless communication, and active systems, such as motorized lacing systems and the like.

In general, and particularly for articles of footwear oriented toward the performance of athletic activities, characteristics such as the size, form, robustness, and weight of the article of footwear may be of particular importance. For instance, the inclusion of electronics in an article of footwear may present challenges as electronics are typically relatively inflexible and fragile while the ordinary use of an article of footwear typically involves bending and flexing and exposure to with moisture from sweat and environmental conditions, among a variety of conditions that are typical for articles of footwear but not for electronics. However, a reliable flexible electronic interconnect between substrates has proven challenging to develop and manufacture.

A flexible electrical interconnect has been developed for use in conjunction with or as part of a footwear airbag. The interconnect allows for a strong interconnection which is tolerant to shear forces typically experienced by articles of footwear. The inclusion of the interconnect with the airbag may be made without compromising the perimeter seal of the airbag, reducing the risk of airbag leaks. In various examples, a flexible electronic assembly is made from a thermoplastic polyurethane (TPU) bond, e.g., through radio frequency (RF) bonding or thermal welding, and includes features that may be resilient to the relatively large sheer forces that may be experienced in an article of footwear while maintaining electrical connection using normal forces. In such examples, the bond to the flexible electronic assembly is separate from the perimeter bond of the airbag, thereby preventing airbag leakage outside of ordinary footwear airbag parameters. Conductive elements may be disposed on the airbag to provide electrical connection between sensors also disposed on the airbag on the flexible electronic assembly. While TPU will be discussed in detail herein, it is to be recognized and understood the principles discussed with respect to TPU will apply as well to any other suitable material or combination of materials.

FIG. 1 is an exploded perspective view of an article of footwear 10 incorporating a flexible electronic assembly 12, in an example embodiment. The article of footwear 10 can comprise an upper 14 and a sole assembly 16. A foot of a wearer of the article of footwear 10 can rest on or within the sole assembly 16, while the upper 14 surrounds the foot to maintain the foot inserted into the article of footwear 10. The sole assembly 16 can comprise an insole 18, a midsole 20, an airbag assembly 21 and an outsole 22. An insole 18 can be inserted into the upper 14. The midsole 20 can be attached to the bottom of the upper 14. The outsole 22 can be attached to the bottom of the midsole 20. The airbag assembly 21 can be incorporated into the sole assembly 16 so as to be viewable in a window 23 of the midsole 20. The airbag assembly 21 can be incorporated into the midsole 20 by any conventional technique such as foam encapsulation or placement in a cut-out portion of a foam midsole. Alternatively, the midsole 20 and/or the outsole 22 may be omitted and the airbag assembly 21 may function in place of the midsole 20 and/or the outsole 22. The airbag assembly 21 can be configured to include the flexible electric assembly 12 embedded therein. The airbag assembly 21 can provide a clean, low wear, safe and hidden location for the flexible electric assembly 12.

The article of footwear 10 has a medial, or inner, side 24 and a lateral, or outer, side 26. For purposes of general reference, the article of footwear 10 may be divided into three general portions: a forefoot portion 28, a mid-foot portion 30, and a heel portion 32. The portions 28, 30 and 32 are not intended to demarcate precise areas of article of footwear 10, rather, they are intended to represent general areas of article of the footwear 10 that provide a frame of reference during the following discussion. Furthermore, although the present description is written with reference to an athletic shoe, the disclosure of the present application can be applied equally to other types of footwear, such as, but not limited to, dress shoes, running shoes, golf shoes, tennis shoes, sandals, boots, slippers and the like.

The sole assembly 16, which is generally disposed between the foot of the wearer and the ground, provides attenuation of ground reaction forces (i.e., imparting cushioning), traction, and may control foot motions, such as pronation. The insole 18 can typically comprises a removable insert disposed atop the airbag assembly 21 or midsole 20, and can provide additional cushioning or ventilation (e.g. by including perforations). The midsole 20 can be attached to the upper 14 and function as the primary shock-attenuating and energy-absorbing component of the article of footwear 10. The midsole 20 can be secured to the upper 14 by adhesive or other suitable means. Suitable materials for the midsole 20 include polymer foam materials such as ethylvinylacetate or polyurethane, or any other material that compresses resiliently. The outsole 22 can be attached to the lower surface of the midsole 20 by adhesive or other suitable means. Suitable materials for the outsole 22 include polymers, e.g., polyether-block co-polyamide polymers (sold as Pebax® by ATOFINA Chemicals of Philadelphia, Pa.), and nylon resins such as Zytel®, sold by Dupont. Other suitable materials for the outsole 22 will become readily apparent to those skilled in the art, given the benefit of this disclosure. In certain embodiments, the sole assembly 16 may not include an outsole layer separate from the midsole 20 but, rather, the outsole may comprise a bottom surface of the midsole 20 that provides the external traction surface of the sole assembly 16.

Various embodiments of the flexible electronic assembly 12 of the present disclosure can be incorporated into various designs of the airbag assembly 21. For example, the airbag assembly 21 may include an airbag substrate forming an air bladder comprising two plies of polymeric membrane, as is described in U.S. Pat. No. 5,802,739 to Potter et al. In another embodiment, a four-ply air bladder may be used, as is described in U.S. Pat. No. 6,402,879 to Tawney et al. In yet another embodiment, a fabric cushioning element may be used, as is described in U.S. Pat. No. 8,764,931 to Turner. The entire contents of U.S. Pat. Nos. 5,802,739; 6,402,879; and 8,764,931 are hereby incorporated by this reference for all purposes. In yet other embodiments, a bladder may be filled with other gases, such as nitrogen, helium or so-called dense gases such as sulfur hexafluoride, a liquid, or gel. In various examples, notwithstanding the material disclosed in the U.S. Pat. Nos. 5,802,739; 6,402,879; and 8,764,931, the airbag substrate may be formed in part from (TPU) and according to the principles disclosed in those patents. In various examples, TPU forms at least one ply of the airbag substrate and/or is a blended component of one or more plies.

Figure 2:
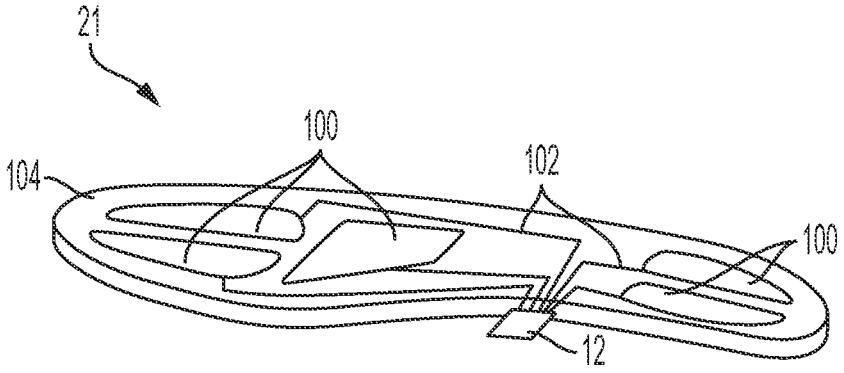
FIG. 2 is a depiction of an airbag assembly incorporating a flexible electronic assembly, in an example embodiment.

FIG. 2 is a depiction of the airbag assembly 21 incorporating the flexible electronic assembly 12, in an example embodiment. The airbag assembly 21 incorporates the flexible electronic assembly 12 in the context of a capacitive sensing system, as will be disclosed further herein. The airbag assembly 21 includes capacitive electrodes 100 coupled to the flexible electronic assembly 12 with conductive elements 102 disposed on an airbag substrate 104. In an example, the conductive elements 102 are silver traces, such as printed silver ink, but it is to be recognized and understood that the conductive elements 102 may be any suitable material that may be disposed on the airbag substrate 104 or on a material that may itself be secured to or disposed on the airbag substrate 104.

The depiction of the airbag assembly 21 is general and it is to be recognized and understood that the airbag assembly 21 may be built according to a variety of principles disclosed herein. In various examples, while the flexible electronic assembly 12 is depicted as partially extending from the airbag substrate 104, in various examples disclosed herein the flexible electronic assembly 12 may be fully enclosed in the airbag substrate 104. In various examples, the conductive elements 102 are disposed on an outer surface of the airbag substrate 104, on the inner surface of the airbag substrate 104, or both, with some conductive elements 102 disposed on the outer surface and some conductive elements 102 disposed on the inner surface. Similarly, the capacitive electrodes 100 may be disposed on the outer surface of the airbag substrate 104, the inner surface, or both, with some capacitive electrodes 100 disposed on the outer surface and some capacitive electrodes 100 disposed on the inner surface.

The flexible electronic assembly 12 may be or include a flexible printed circuit board (PCB). Alternatively, the flexible electronic assembly 12 may include a rigid PCB but include flexible elements or that allow connections with or between the conductive elements 102 to flex, as described herein. As such, while the flexible electronic assembly 12 may not be fully flexible, it is to be recognized and understood that the flexible electronic assembly 12 does include certain flexible elements.

In various examples, the flexible electronic assembly 12 does not include active electronics but rather acts to provide connections between the conductive elements 102 and electronics included elsewhere in a system. Alternatively, the flexible electronic assembly 12 does include active electronics, e.g., related to the operation of the capacitive electrodes 100 in the context of a capacitive sensor system.

Figure 3:
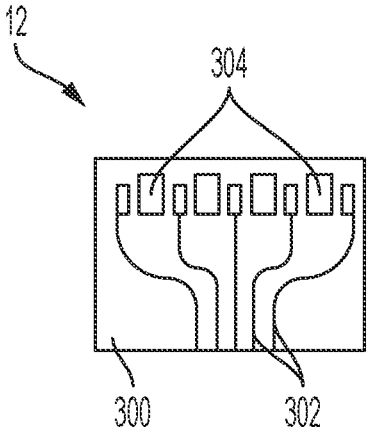
FIG. 3 is a depiction of a flexible electronic assembly, in an example embodiment.

FIG. 3 is a depiction of the flexible electronic assembly 12, in an example embodiment. In the example embodiment, the flexible electronic assembly 12 does not include active electronics but instead serves as a connector or interconnect with electronics positioned elsewhere, either in the article of footwear 10 or remote to the article of footwear 10. However, as noted above, various examples of the flexible electronic assembly 12 may include active electronics.

The flexible electronic assembly 12 includes a PCB 300, conductive elements 302, and through holes 304. In various examples, the PCB 300 is a flexible PCB or a rigid PCB. In various examples, the conductive elements 302 are the same or similar to the conductive elements 102 disposed on the airbag substrate 104 (FIG. 2), e.g., silver traces disposed on the PCB 300, but any suitable conductive lines may be utilized that are able to electrically couple with the conductive traces 104. The through holes 304 are cutouts in or are otherwise formed by the PCB 300 and are configured to allow a weld to be formed through the through holes 304 to secure the flexible electronic assembly 12 within the airbag assembly 21.

Figure 4:
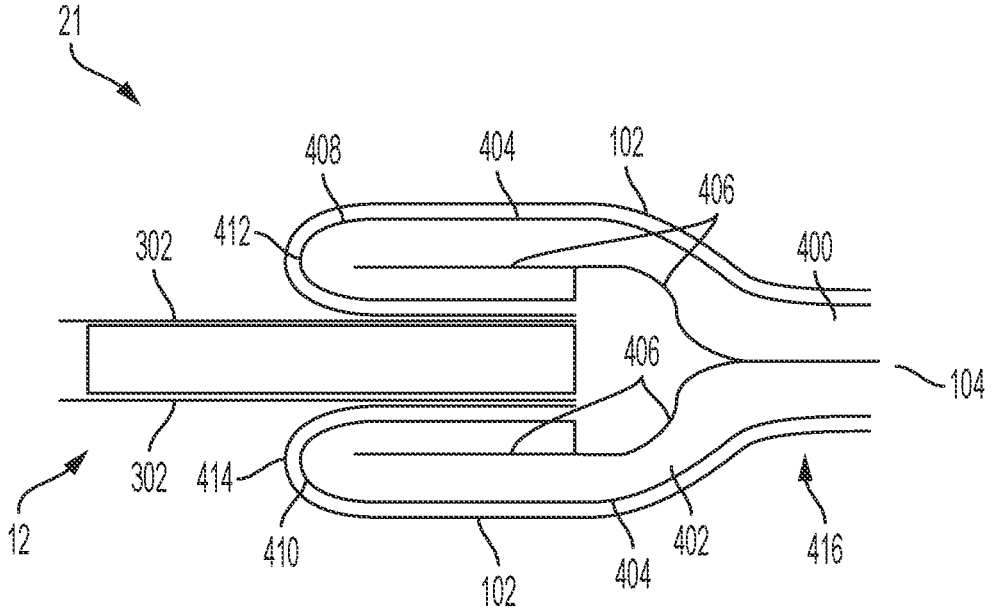
FIG. 4 is a detailed profile view of an airbag assembly and, in particular, the interconnect between a flexible electronic assembly and an airbag substrate, in an example embodiment.

FIG. 4 is a detailed profile view of the airbag assembly 21 and, in particular, the interconnect between the flexible electronic assembly 12 and the airbag substrate 104, in an example embodiment. The flexible electronic assembly 12 is positioned in part between a first sheet 400 of the airbag substrate 104 and a second sheet 402 of the airbag substrate 400. The conductive elements 102 are disposed on the outer surface 404 of the airbag substrate 104, though as noted in alternative examples the conductive elements may alternatively or additionally be positioned on the inner surface 406 of the airbag substrate 104. The conductive elements 102 are electrically coupled to the conductive elements 302 of the flexible electronic assembly 12.

In the illustrated example, the interconnect between the flexible electronic assembly 12 and the airbag substrate 104 is formed from two connections. The outer surface 404 of each sheet 400, 402 is in contact with the flexible electronic assembly 12 such that each of the conductive elements 102 are in electrical contact with an associated conductive element 302. The airbag substrate 104 may then be heated, welded, or otherwise operated on such that the airbag substrate 104 of each of the sheets 400, 402 melts or flows into the through holes 304 (not depicted) and, upon cooling, forms a bond, such as a TPU bond, between the first sheet 400 and the second sheet 402 within some or all of the through holes 304.

Each sheet 400, 402 is also formed into a fold 408, 410, with the inner surface 406 in contact with itself and the conductive elements 102 following the outer surface 404 around an outer edge 412, 414 of the fold 408, 410, respectively. The airbag substrate 104 is then welded at a weld section 416, e.g., through RF bonding or any suitable welding technique suitable to weld the airbag substrate 104 given that the airbag substrate 104 includes or is comprised of TPU, to form a seal between the first and second sheets 400, 402 and form a pocket in which the flexible electronic assembly 12 is positioned. The seal my be consistent with the seal around a complete perimeter of the airbag substrate 104 that provides for a suitable level of leakage out of the airbag assembly 21 such that the airbag assembly 21 remains at a desired pressure over a period of years. Consequently, the presence of the flexible electronic assembly 12 may not provide for measurably increased leakage out of the airbag assembly 21 relative to airbags that do not include the flexible electronic assembly 12.

Figure 5A:
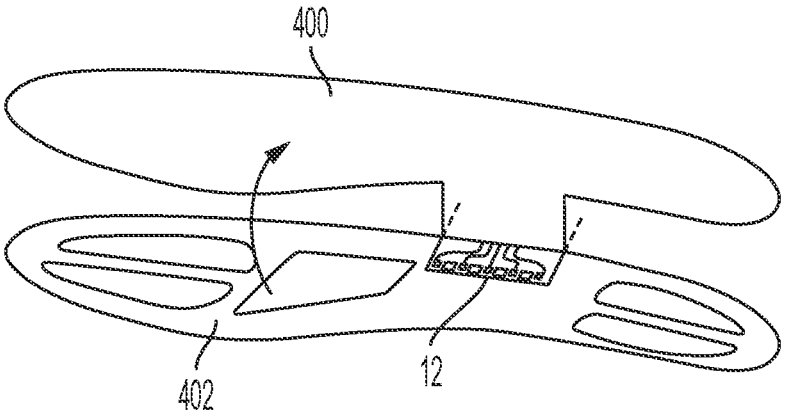
FIGS. 5A and 5B illustrate a process for making or assembling an airbag assembly, as described with respect to FIG. 4, in an example embodiment.
Figure 5B:
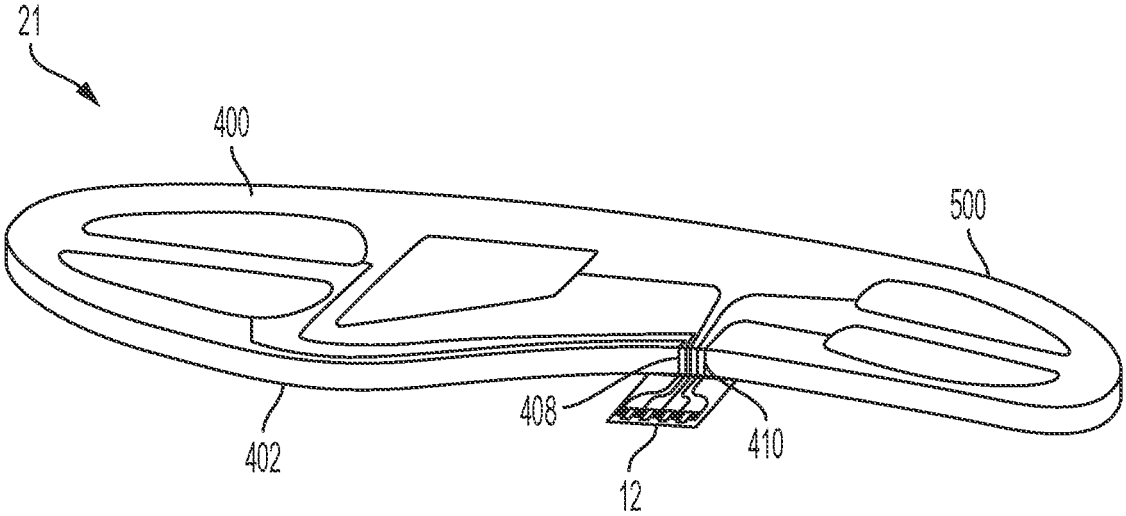

FIGS. 5A and 5B illustrate a process for making or assembling the airbag assembly 21, as described with respect to FIG. 4, in an example embodiment. In FIG. 5A the first and second sheets 400, 402 are secured to the flexible electronic assembly 12 as described above, at least in part by bonding within or through the through holes 304 (not depicted). In the illustrated example of FIG. 5A, the first and second sheets 400, 402 are both substantially perpendicular to the flexible electronic assembly 12. At this point in the assembly process, the folds 408, 410 are partially but not fully made.

In FIG. 5B, the first and second sheets 400, 402, are completely folded over and welded or bonded together to form the airbag assembly 21. In this example, the welding or bonding may be implemented around a complete perimeter 500 of the first and second sheets 400, 402 in order to seal the first and second sheets 400, 402 to form the airbag of the airbag assembly 21.

Figure 6A:
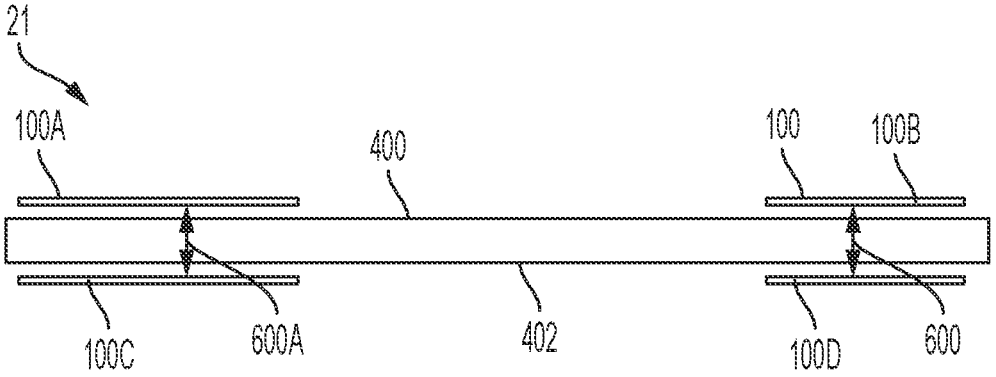
FIGS. 6A and 6B are simplified side views of an airbag assembly in different states to illustrate the spatial relationship of capacitive electrodes on two sheets, in an example embodiment.
Figure 6B:
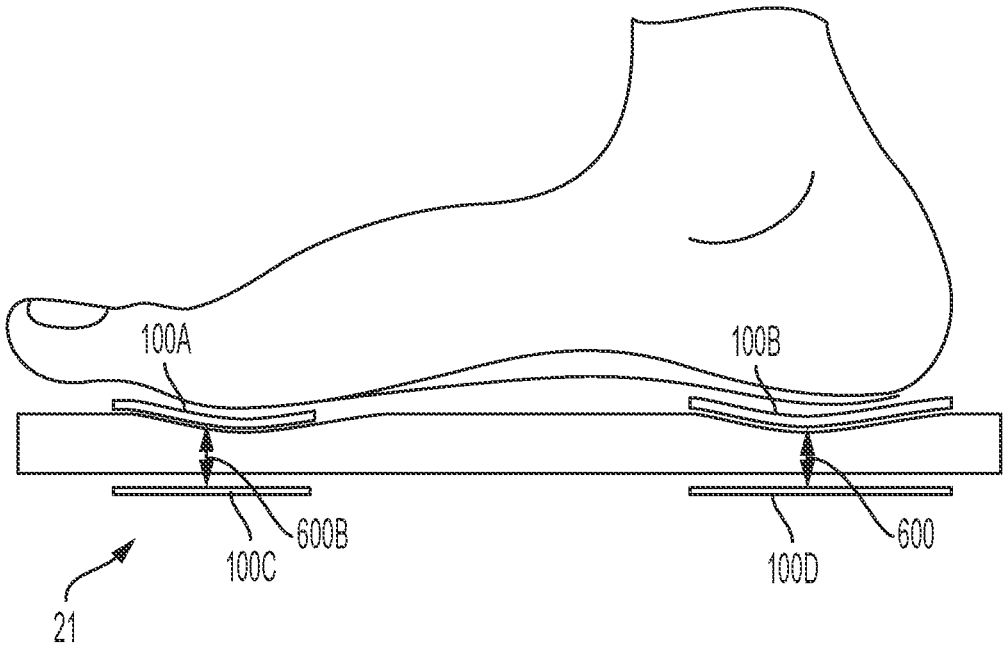

FIGS. 6A and 6B are simplified side views of the airbag assembly 21 in different states to illustrate the spatial relationship of the capacitive electrodes 100 on the two sheets 400, 402, in an example embodiment. In FIG. 6A, the airbag assembly 21 is in a relaxed state while the airbag assembly 21 in FIG. 6B is in a compressed state owing to the presence of a foot bearing down on the airbag assembly 21.

Certain capacitive electrodes 100A, 100B on the first sheet 400 have associated capacitive electrodes 100C, 100D on the second sheet 402. As such, an associated pair of capacitive electrodes, e.g., 100A, 100C, substantially overlap one another and are positioned immediately above and below either other when viewed from above the airbag assembly 21. Each pair of capacitive electrodes, e.g., 100A, 100C have a vertical separation 600 that may increase or decrease based on the compression or lack thereof of the airbag assembly 21. In the illustrated example, where the airbag assembly 21 is in the relaxed state of FIG. 6A, the vertical separation 600A is greater than the vertical separation 600B when the airbag assembly 21 is in the compressed state of FIG. 6B.

Each pair of capacitive electrodes, e.g., 100A, 100C, has an inherent capacitance therebetween that varies based on the vertical separation 600. As the vertical separation 600 decreases the capacitance between the electrodes 100A, 100C increases, and as the vertical separation increases the capacitance between the electrodes 100A, 100C decreases. The capacitance between two electrodes—whether the electrodes are physical electrodes or another reference point, such as a human body part—can be measured according to principles known in the art, e.g., in U.S. Patent Application Publication No. 2018/0199674, "FOOT PRESENCE SIGNAL PROCESSING USING VELOCITY", filed Mar. 14, 2018, and Patent Cooperation Treaty application number US2020/022653, "TOUCH INTERFACE FOR ACTIVE FOOTWEAR SYSTEMS", filed Mar. 13, 2020, both of which are incorporated by reference herein in their entirety.

As described herein, each capacitive electrode 100 is coupled to an associated conductive element 302 on the flexible electronic assembly 12 via a conductive element 102. In an example, the flexible electronic assembly 12 is then coupled to electronics included elsewhere to sense a change in voltage or other electrical property between associated or paired capacitive electrodes 100A, 100C and, on the basis of the change in the electrical property, identify that the airbag assembly 21 is being or has been compressed or relaxed and, by extension, that something, such as a foot, has been inserted into the associated article of footwear 10. Alternatively, some or all of the electronics to sense the change in voltage or other electrical property and identify that the airbag assembly 21 has been compressed or relaxed may be included as native components of the flexible assembly 12.

Moreover, changes in the electrical property between different pairs of capacitive electrodes 100 may be indicative of different circumstances. For instance, as a foot is inserted into the article of footwear 10, a first pair of capacitive electrodes 100B, 100D may compress first and thus show a change in the electrical property before a change in the electrical property is shown in a second pair of capacitive electrodes 100A, 100C as the foot moves deeper into the article of footwear 10. Similarly, as the foot is withdrawn from the article of footwear 10 the electrical property of the second pair of capacitive electrodes 100A, 100C may change before a change in the electrical property of the first pair of capacitive electrodes 100B, 100D.

Similarly, use of the article of footwear 10 may tend to produce different changes in the electrical property between different pairs of capacitive electrodes 100. In an example, if the article of footwear 10 is being used during running, compression on the airbag assembly 21 may occur in different locations at different times and in different patterns, e.g., because of a footfall occurring and how the footfall occurs. For instance, if a wearer tends to land on the front of their foot while running then the vertical distance 600 between the second pair of electrodes 100A, 100C may decrease more than the vertical distance 600 between the first pair of electrodes 100B, 100D on each foot strike, and thereby indicate that the wearer is forefoot striking while running. The above examples are presented by way of illustration, and it is to be recognized and understood that the use of the capacitive electrodes 100 and the change in the electrical property between the capacitive electrodes 100 over time may provide a variety of insights in when and how the article of footwear 10 is being used.

Figure 7:
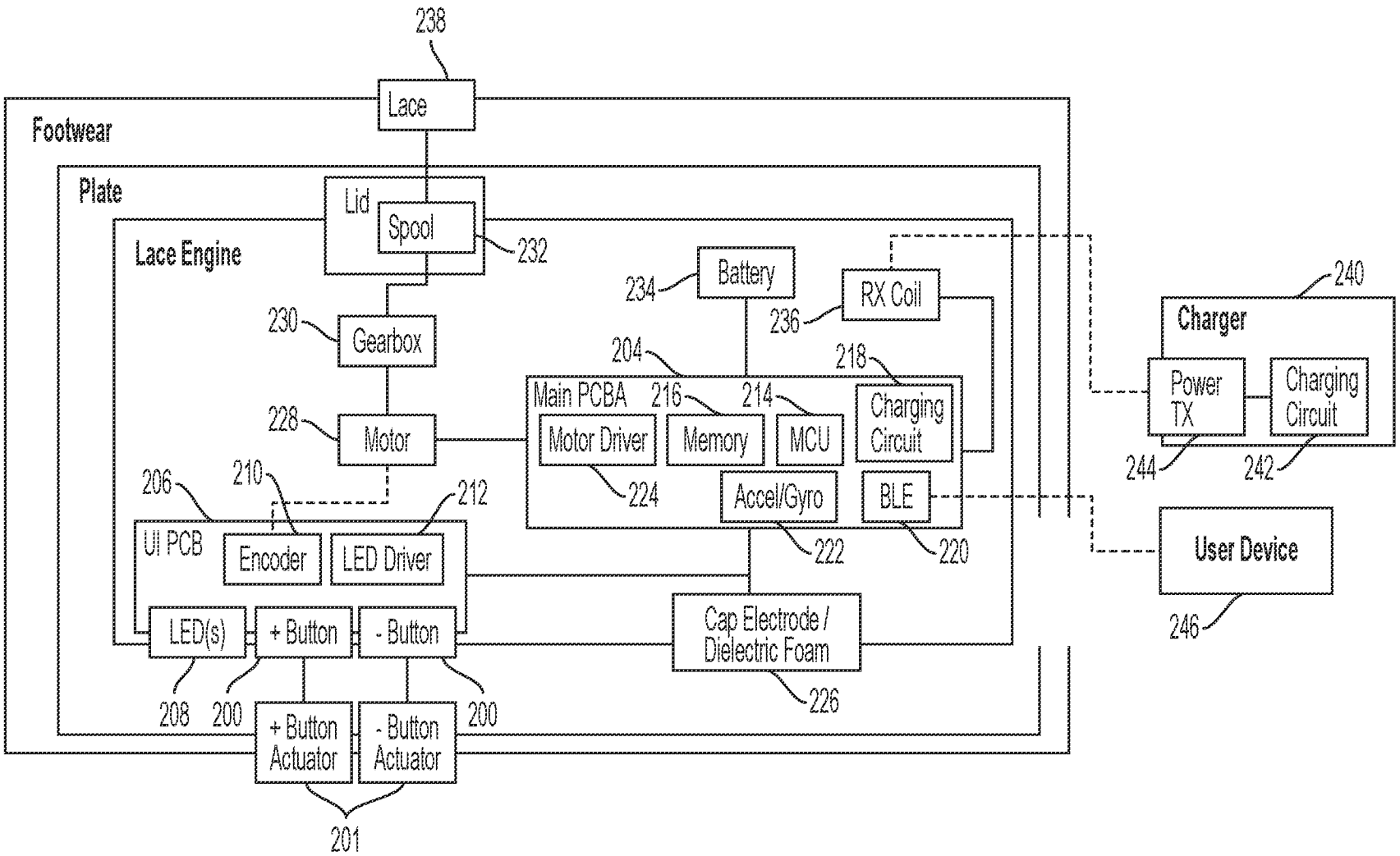
FIG. 7 is a block diagram of components of a system that can process information from capacitive electrodes, in an example embodiment.

FIG. 7 is a block diagram of components of a system that can process information from the capacitive electrodes 100, in an example embodiment. The block diagram includes components that may be utilized in autolacing footwear. In such an example, the output from the capacitive electrodes 100 may be utilized in the operation of the lacing engine The lacing engine includes interface buttons 200, interface button actuators 201, and a lacing engine housing enclosing a main PCB 204 and a user interface PCB 206. The user interface PCB 206 includes the buttons 200, one or more light emitting diodes (LEDs) 208 which may illuminate the button actuators 201 or otherwise provide illumination visible outside of the article of footwear, an optical encoder unit 210, and an LED driver 212 which may provide power to the LEDs 208. The main PCB 204 includes a processor circuit 214, an electronic data storage 216, a battery charging circuit 218, a wireless transceiver 220, one or more sensors 222, such as accelerometers, gyroscopes, and the like, and a motor driver 224.

The lacing engine includes a foot presence sensor 226 operatively coupled to the capacitive electrodes 100 via the flexible electronic assembly 12, a motor 228, a transmission 230, a spool 232, a battery or power source 234, and a charging coil 236. The foot presence sensor 226 may receive information from the capacitive electrodes 100 indicative of the electrical property and identify changes in the electrical property between each pair of capacitive electrodes 100. On the basis of the electrical property and the change in the electrical property, the foot presence sensor 226 may identify the presence of a foot and how the article of footwear 10 is being worn and/or used by the wearer.

The processor circuit 214 is configured with instructions from the electronic data storage 216 to cause motor driver 224 to activate the motor 228 to turn the spool 232 by way of the transmission 230 in order to place a desired amount of tension on a lace 238 wound about the spool 232. The processor circuit 214 may receive inputs from a variety of sources, including the foot presence sensor 226, the sensors 222, and the buttons 200, to decide, according to the instructions, to increase or decrease the tension on the lace 238. For instance, the foot presence sensor 226 may detect the presence of a foot in the footwear 198, and the processor circuit 216 may set the tension to a present tension level. The sensors 222 may detect movement consistent with a particular activity level, e.g., causal walking, a vigorous physical activity, etc., and the processor circuit 214 may cause the tension to be set to a level consistent with that activity level, e.g., relatively loose for casual walking and relatively tight for vigorous physical activity. A user may press the button actuators 201 to manually command an incremental or linear increase or decrease in tension as desired.

The battery 234 provides power for the components of the lacing engine 102 in general and is, in the example embodiment, a rechargeable battery. However, alternative power sources, such as non-rechargeable batteries, super capacitors, and the like, are also contemplated. In the illustrated example, the battery 234 is coupled to the charging circuit 218 and the recharge coil 236. When the recharge coil 236 is placed in proximity of an external charger 240, a charging circuit 242 may energize a transmit coil 244 to inductively induce a current in the recharge coil 236, which is then utilized by the charging circuit 218 to recharge the battery 234. Alternative recharging mechanisms are contemplated, such as a piezoelectric generator located within the footwear 198.

The wireless transceiver 220 is configured to communicate wirelessly with a remote user device 246, such as a smartphone, wearable device, tablet computer, personal computer, and the like. In example, the wireless transceiver 220 is configured to communicate according to the Bluetooth Low Energy modality, though the wireless transceiver 220 may communicate according to any suitable wireless modality, including near field communication (NFC), 802.11 WiFi, and the like. Moreover, the wireless transceiver 220 may be configured to communicate with multiple external user devices 246 and/or according to multiple different wireless modalities. The wireless transceiver 220 may receive instructions from the user device 246, e.g., using an application operating on the user device 246, for controlling the lacing engine 102, including to enter predetermined modes of operation or to incrementally or linearly increase or decrease the tension on the lace 238. The wireless transceiver 220 may further transmit information about the lace engine 102 to the user device 246, e.g., an amount of tension on the lace 238 or otherwise an orientation of the spool 232, an amount of charge remaining on the battery 234, and any other desired information about the lacing engine generally.

Figure 8:
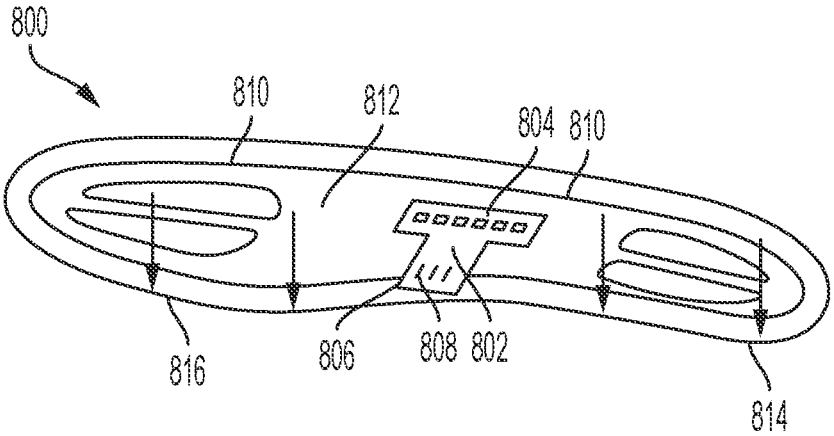
FIG. 8 is a depiction of an airbag assembly that includes an alternative electronic assembly, in an example embodiment.

FIG. 8 is a depiction of an airbag assembly 800 that includes an alternative electronic assembly 802, in an example embodiment. The electronic assembly 802 may be the same or similar to the flexible electronic assembly 21, and in various examples, the electronic assembly 802 is a flexible electronic assembly. However, in various alternative examples, the electronic assembly 802 is not a flexible electronic assembly and is instead a conventional rigid PCB.

In the illustrated example, the electronic assembly 802 is contained in part within the airbag assembly 800 and includes active electronics in the internal portion 804 contained within a pocket of the airbag assembly 800. An external portion 806 of the electronic assembly 802 protrudes from the airbag assembly 800. The external portion 806 includes conductive elements 808 configured to be coupled to conductors from an external electronic device.

The electronic assembly 802 includes active electronics, such as the sensor 226, e.g., as the foot presence sensor 226 or more broadly a capacitive sensor configured to register changes in the electrical property between the capacitive electrodes 100. In an example, the electronic assembly 802 additionally includes the MCU 214, memory 216, and a power source 234, such as a battery, piezoelectric generator, and the like. The MCU may be the processor for the sensor 226 or may support the sensor 226. Additionally or alternatively, the electronic assembly 802 may not incorporate the sensor 226 but may instead transmit raw or generally unprocessed data from the capacitive electrodes 100 via conductive elements 808 of the electronic assembly 802 to another device, such as the user device 246, a lacing engine contained elsewhere in the article of footwear 10, or another source of processing power, and the interpretation of the data from the capacitive electrodes may be performed at that location remote to the electronic assembly 802.

In such an example, all of the conductive elements 810 disposed on the airbag substrate 812 of the airbag assembly 800 are on the interior surface of the airbag substrate 812. In such an example, no conductive elements 810 are thus on an exterior surface and are not subject to any environmental factors. In various examples, all of the conductive elements 810 disposed on the airbag substrate 812 couple with the conductive elements 808 of the electronic assembly 802 on the internal portion 804 of the electronic assembly 802.

The sheets of the airbag substrate 812 are welded or otherwise secured to one another around a complete perimeter 814 of the airbag assembly 800. As disclosed herein, the airbag substrate 812 includes or is formed from TPU and the weld or securing mechanism is any of a variety of mechanisms that forms a TPU seal 816. Consequently, the external portion 806 of the electronic assembly 802 may be understood to be the portion of the electronic assembly 802 that extends beyond the seal 816.

Alternatively, the electronic assembly 802 may be wholly contained within the airbag assembly 800 and no portion extends beyond the seal 816 around the airbag assembly 800. In such an example, the electronic assembly 802 further includes the wireless transmitter 220 to provide at least for the transmission and, in certain examples, the receipt of wireless transmissions. In such an example, the electronic assembly 802 may transmit information from the sensor 226 and in certain examples receive information for use by other components of the electronic assembly 802.

Figure 9:
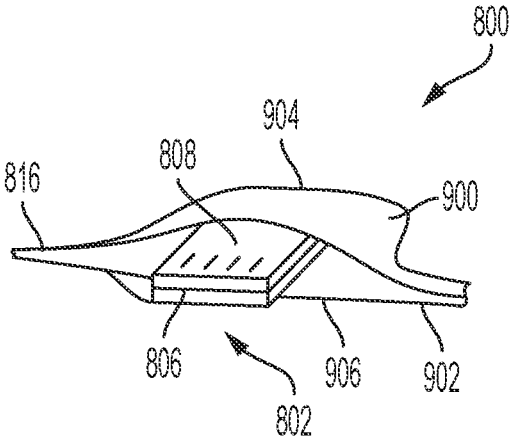
FIG. 9 is a detailed depiction of the external portion of an electronic assembly relative to a TPU seal of an airbag assembly, in an example embodiment.

FIG. 9 is a detailed depiction of the external portion 806 of the electronic assembly 802 relative to the TPU seal 816 of the airbag assembly 800, in an example embodiment. In such an example, each of a first sheet 900 and a second sheet 902 of the airbag substrate 812 includes a folded portion 904, 906, respectively, to expose the external portion 806 of the electronic assembly 802 and the conductive elements 810 contained thereon. The TPU seal 816 then extends over the folded portions 904, 906, thereby sealing the first and second sheets 900, 902 around the electronic assembly 802.

Figure 10:
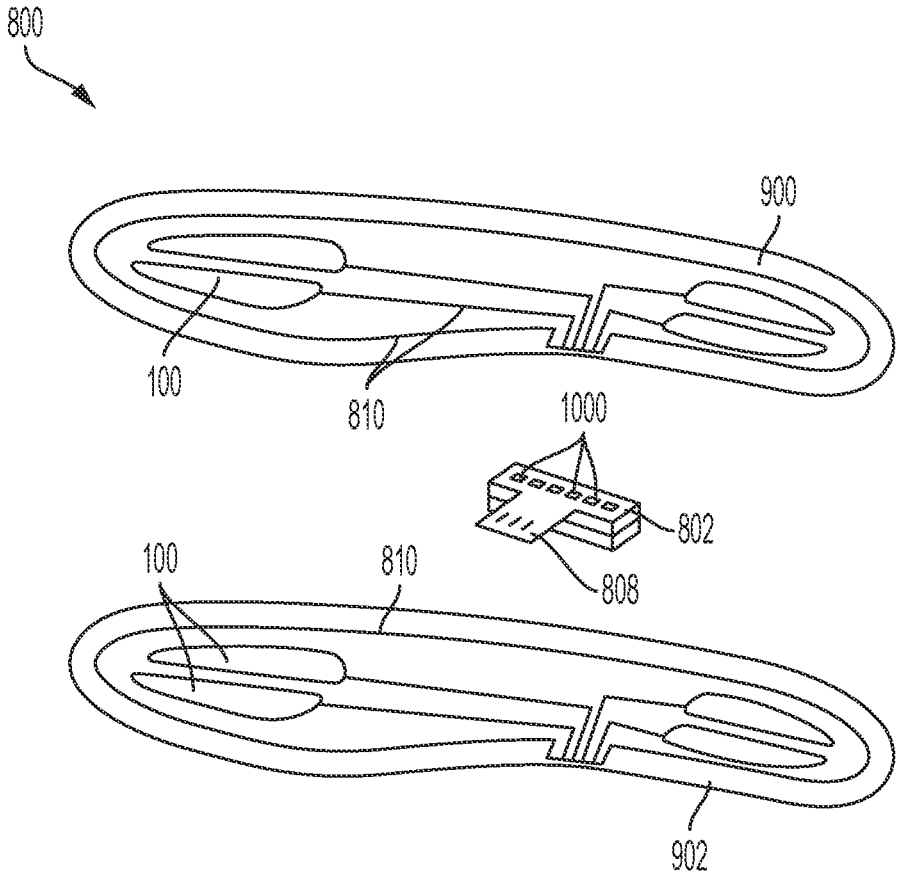
FIG. 10 is an exploded view or pre-assembly view of an airbag assembly, in an example embodiment.

FIG. 10 is an exploded view or pre-assembly view of the airbag assembly 800, in an example embodiment. The first sheet 900 includes capacitive electrodes 100 and conductive elements 810 disposed on an interior surface of the first sheet 900. The second sheet 902 includes capacitive electrodes 100 and conductive elements 810 disclosed on an interior surface of the second sheet 902 facing the interior surface of the first sheet 900. The electronic assembly 802 includes active electronics 1000, e.g., the MCU 214, memory 216, and a power source 234 among other components disclosed herein, and conductive elements 808 configured to electrically couple with the conductive elements 810 disposed on the first and second sheets 900, 902.

Figure 11:
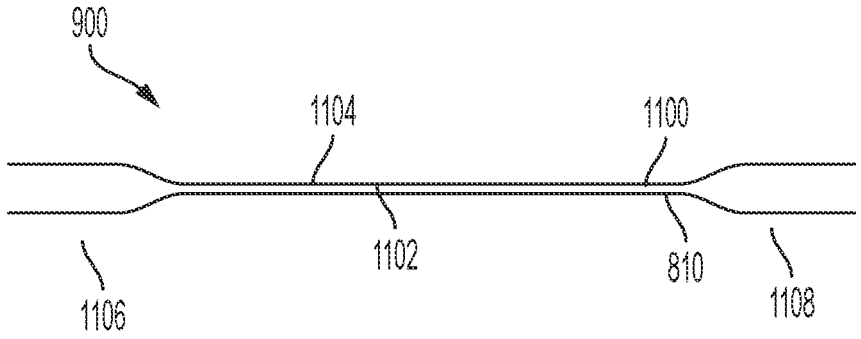
FIG. 11 is a side detail view of a first sheet, in an example embodiment.

FIG. 11 is a side detail view of the first sheet 900, in an example embodiment. While FIG. 11 is described with respect to the first sheet 900 the principles apply as well to the second sheet 902.

The first sheet includes at least one ply 1100 either of TPU or including TPU along with other suitable materials. The conductive elements 810, e.g., silver traces, are disposed on the inner surface 1102 of the first sheet 900. The conductive elements 810 are not disposed on the outer surface 1104 of the ply 1100. The ply 1100 is not laminated at the edges 1106, 1108 of the ply 1100 to facilitate making the TPU seal 816 and folded portions 904, 906 (FIG. 9). While the conductive elements 810 are shown as being disposed on the ply 1100, it is noted that the conductive elements may be on a separate ply (not depicted) that is laminated to the ply 1100. However, the separate ply may not be laminated at the edges 1106, 1108.

Figure 12A:
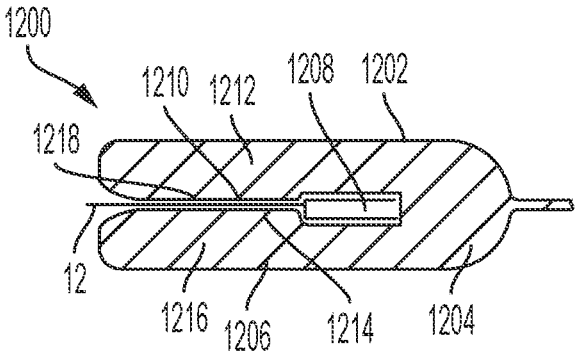
FIGS. 12A and 12B are side and perspective depictions, respectively, of an airbag assembly, in an example embodiment.
Figure 12B:
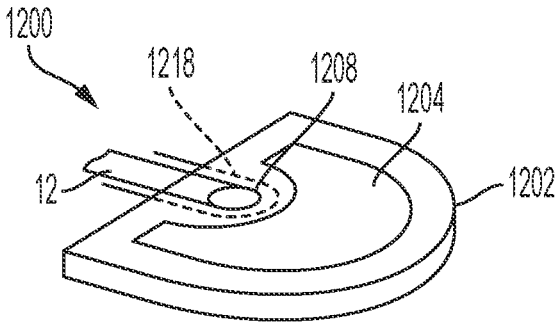

FIGS. 12A and 12B are side and perspective depictions, respectively, of an airbag assembly 1200, in an example embodiment. The airbag assembly 1200 may be functionally the same or similar to airbag assemblies disclosed herein, such as the airbag assembly 21 and the airbag assembly 800, in that the airbag assembly 1200, including the flexible electronic assembly 12, may function as a pressure sensor. Alternatively, the airbag assembly 1200 may incorporate the flexible electronic assembly 802 instead of or in addition to the flexible electronic assembly 12. Moreover, the airbag assembly 1200 may include common components and layouts as the airbag assembly 21 and/or the airbag assembly 800, such as the formation of the airbag substrate 1202 based on a first sheet and a second sheet, which may be the same or similar to the first sheet 900 and the second sheet 902 of FIG. 9, respectively, and the materials with which the first and second sheets 900, 902 are made, including TPU.

However, the airbag assembly 1200 incorporates certain features and assembly methods that may differ from the airbag assembly 21 and/or the airbag assembly 800. In the illustrated example, the airbag assembly 1200 includes fibers 1204 extending between the interior surface 1206 of the airbag assembly 1200. The fibers 1204 may improve structural resilience of the airbag assembly 1200 relative to the airbag assemblies 21, 800, as well as provide performance differences in various applications. The fibers 1204 may be implemented as disclosed in U.S. Pat. No. 8,479,412, TETHERED FLUID-FILLED CHAMBERS, Peyton et al., filed Dec. 3, 2009, and U.S. Patent Publication No. 2019/0365043, SPACER TEXTILE MATERIALS AND METHODS FOR MANUFACTURING THE SPACER TEXTILE MATERIAL, Hazenberg et al., filed Aug. 19, 2019, both of which are incorporated herein by reference in their entirety.

Moreover, the airbag assembly 1200 may be formed according to an alternative process than the processes described with respect to the airbag assemblies 21, 800. In particular, the airbag assembly 1200 may be formed according to principles and processes described with respect to U.S. Patent Application Publication No. 2020/0260819, MIDSOLE SYSTEM WITH GRADED RESPONSE, Case et al., filed on May 5, 2020, and U.S. application Ser. No. 17/207,322, Elder et al., FOOTWEAR WITH FLUID-FILLED BLADDER, filed on Mar. 19, 2021, which claims the benefit of priority to U.S. Provisional Patent Application No. 63/030,344, all of which are incorporated by reference here in in their entirety. In general, the processes described above provide for the formation of a pocket 1208 between a first sheet 1210 of a first portion 1212 and a second sheet 1214 of a second portion 1216 of the airbag assembly 1200. The flexible electronic assembly 12 is positioned or seated in the pocket 1208 and the airbag substrate 1202 of the first sheet 1210 and the second sheet 1214 melted in a melt region 1218 to seal the airbag substrate 1202 around the pocket and provide environmental isolation for the flexible electronic assembly 12. As a result, force placed on the airbag assembly 1200 generally may be imparted on and sensed by the flexible electronic assembly 12.

While the airbag assembly 1200 is described with respect to the process noted above, it is noted and emphasized the airbag assembly 1200 may be formed according to the processes described with respect to the airbag assemblies 21, 800. Moreover, conversely, the airbag assemblies 21, 800 may be formed according to the process described with respect to the airbag assembly 1200. Moreover, the airbag assembly 1200 and flexible electronic assembly 12 may perform any of the functions described with respect to the airbag assemblies 21, 800.

Figure 13:
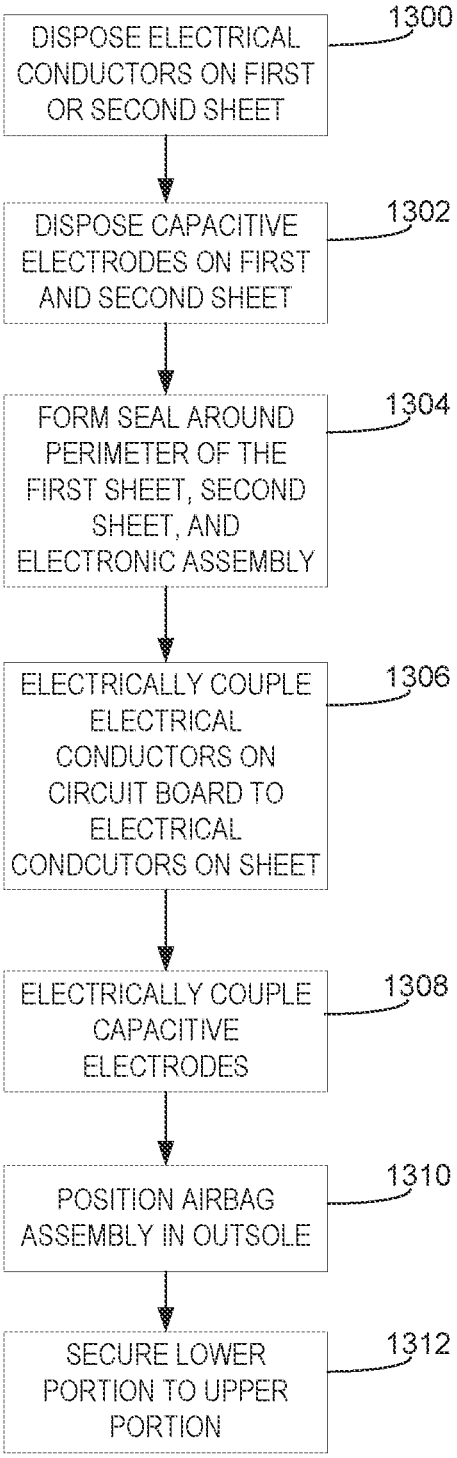
FIG. 13 is a flowchart for making an article of footwear in an example embodiment.

FIG. 13 is a flowchart for making an article of footwear in an example embodiment. It is to recognized and understood that portions of the flowchart may be performed to make an airbag assembly, such as the airbag assemblies 21, 800, 1200 disclosed herein, without respect to the incorporation of the airbag assembly into an article of footwear.

At 1300, electrical conductors are disposed on at least one of a first sheet or a second sheet. In an example, disposing the electrical conductors includes disposing the electrical conductors on an interior surface of an associated one of the first and second sheets.

At 1302, capacitive electrodes are disposed on either the exterior surface of first and second sheets or the interior surface of the first and second sheets. In an example, disposing the capacitive electrodes includes disposing capacitive electrodes to form capacitive electrode pairs, one capacitive electrode of each pair on the first sheet and the other capacitive electrode of each pair on the second sheet opposed to the other electrode of the pair, wherein a change in an electrical property of the capacitive electrodes of a pair is indicative of a change in compression of the airbag assembly.

At 1304, a seal is formed around a perimeter of the first sheet, the second sheet and an electronic assembly to form an airbag assembly, the electronic assembly comprising a circuit board and electrical conductors disposed on the circuit board, wherein an internal portion of the electronic assembly is disposed between the first and second sheets and within the seal formed therebetween and an external portion of the electronic assembly is disposed outside of the seal. In an example, the circuit board is a flexible circuit board, the flexible circuit board forms through holes, and forming the seal includes bonding the first and second sheets to one another through the through holes. In an example, forming the seal includes forming a fold in each of the first and second sheets proximate the through holes at an edge of the first and second sheets and the electrical conductors disposed on the first and second sheets wrap around the fold to come into electrical contact with the electrical conductors on the electronic assembly. In an example, the electronic assembly extends between the first and second sheets, and forming the seal is between the first and second sheets past the extent of the electronic assembly. In an example, forming the seal includes forming a weld. In an example, forming the seal includes placing the electrical conductors of the electronic assembly on the external portion.

In an example, forming the seal includes placing active electronics configured to receive signals from the capacitive electrodes in the interior portion. In an example, the active electronics are configured to process the signals received from the capacitive electrodes and identify a condition of the airbag based on the signals. In an example, the active electronics are configured to transmit the signals to a remote device.

In an example, forming the seal includes disposing the electronic assembly completely within the airbag assembly. In an example, the electronic assembly includes active electronics configured to receive signals from the capacitive electrodes. In an example, the electronic assembly includes active electronics configured to receive signals from the capacitive electrodes. In an example, the active electronics are configured to wirelessly transmit data indicative of the signals to a remote device.

At 1306 the electrical conductors disposed on the circuit board are electrically coupled to an associated one of the electrical conductors disposed on the first or second sheet. In an example, disposing the electrical conductors includes disposing the electrical conductors on an exterior surface of an associated one of the first and second sheets.

At 1308, the capacitive electrodes are electrically coupled to the electrical conductors disposed on the first and second sheets and to the electrical conductors on the circuit board.

At 1310, the airbag assembly is positioned in an outsole of a lower portion of the article of footwear.

At 1312, the lower portion is secured to an upper portion of the article of footwear.

Examples

Example 1 is an article of footwear, comprising: an upper portion; a lower portion, secured to the upper portion, including an out-sole and an airbag assembly, wherein the airbag assembly comprises: a first sheet and a second sheet forming a seal therebetween around a perimeter of the first and second sheets; an electronic assembly, comprising a circuit board and electrical conductors disposed on the circuit board, wherein an internal portion of the electronic assembly is disposed between the first and second sheets and within the seal formed therebetween and an external portion of the electronic assembly is disposed outside of the seal.

In Example 2, the subject matter of Example 1 includes, wherein the airbag assembly further comprises electrical conductors disposed on at least one of the first sheet or the second sheet, the electrical conductors disposed on the circuit board electrically coupled to an associated one of the electrical conductors disposed on the first or second sheet.

In Example 3, the subject matter of Examples 1-2 includes, wherein the electrical conductors are disposed on an exterior surface of an associated one of the first and second sheets.

In Example 4, the subject matter of Examples 2-3 includes, wherein the airbag assembly further comprises capacitive electrodes disposed on the exterior surface of first and second sheets and electrically coupled to the electrical conductors disposed on the first and second sheets and to the electrical conductors on the circuit board.

In Example 5, the subject matter of Examples 3-4 includes, wherein a capacitive electrodes form capacitive electrode pairs, one capacitive electrode of each pair on the first sheet and the other capacitive electrode of each pair on the second sheet opposed to the other electrode of the pair, wherein a change in an electrical property of the capacitive electrodes of a pair is indicative of a change in compression of the airbag assembly.

In Example 6, the subject matter of Examples 2-5 includes, wherein the circuit board is a flexible circuit board and wherein the flexible circuit board forms through holes, and wherein the first and second sheets are bonded to one another through the through holes.

In Example 7, the subject matter of Examples 5-6 includes, wherein the first and second sheets each form a fold proximate the through holes at an edge of the first and second sheets, and wherein the electrical conductors disposed on the first and second sheets wrap around the fold to come into electrical contact with the electrical conductors on the electronic assembly.

In Example 8, the subject matter of Examples 6-7 includes, wherein the electronic assembly extends between the first and second sheets, and wherein the seal is formed between the first and second sheets past the extent of the electronic assembly.

In Example 9, the subject matter of Examples 7-8 includes, wherein the seal is a weld.

In Example 10, the subject matter of Examples 1-9 includes, wherein the electrical conductors are disposed on an interior surface of an associated one of the first and second sheets and further comprising capacitive electrodes disposed on the interior surface of the first and second sheets, the capacitive electrodes electrically coupled to associated electrical conductors disposed on the first and second sheets.

In Example 11, the subject matter of Example 10 includes, wherein the external portion includes the electrical conductors of the electronic assembly.

In Example 12, the subject matter of Examples 10-11 includes, wherein the interior portion includes active electronics configured to receive signals from the capacitive electrodes.

In Example 13, the subject matter of Example 12 includes, wherein the active electronics are configured to process the signals received from the capacitive electrodes and identify a condition of the airbag based on the signals.

In Example 14, the subject matter of Examples 12-13 includes, wherein the active electronics are configured to transmit the signals to a remote device.

In Example 15, the subject matter of Examples 9-14 includes, wherein the electronic assembly completely disposed within the airbag assembly.

In Example 16, the subject matter of Example 15 includes, wherein the electronic assembly includes active electronics configured to receive signals from the capacitive electrodes.

In Example 17, the subject matter of Example 16 includes, wherein the electronic assembly includes active electronics configured to receive signals from the capacitive electrodes.

In Example 18, the subject matter of Example 17 includes, wherein the active electronics are configured to wirelessly transmit data indicative of the signals to a remote device.

Example 19 is a method of making an article of footwear, comprising: forming a seal around a perimeter of a first sheet, a second sheet and an electronic assembly to form an airbag assembly, the electronic assembly comprising a circuit board and electrical conductors disposed on the circuit board, wherein an internal portion of the electronic assembly is disposed between the first and second sheets and within the seal formed therebetween and an external portion of the electronic assembly is disposed outside of the seal; positioning the airbag assembly in an outsole of a lower portion of the article of footwear; and securing the lower portion to an upper portion of the article of footwear.

In Example 20, the subject matter of Example 19 includes, disposing electrical conductors on at least one of the first sheet or the second sheet; and electrically coupling the electrical conductors disposed on the circuit board electrically to an associated one of the electrical conductors disposed on the first or second sheet.

In Example 21, the subject matter of Example 20 includes, wherein disposing the electrical conductors includes disposing the electrical conductors on an exterior surface of an associated one of the first and second sheets.

In Example 22, the subject matter of Example 21 includes, disposing capacitive electrodes on the exterior surface of first and second sheets; and electrically coupling the capacitive electrodes to the electrical conductors disposed on the first and second sheets and to the electrical conductors on the circuit board.

In Example 23, the subject matter of Example 22 includes, wherein disposing the capacitive electrodes includes disposing capacitive electrodes to form capacitive electrode pairs, one capacitive electrode of each pair on the first sheet and the other capacitive electrode of each pair on the second sheet opposed to the other electrode of the pair, wherein a change in an electrical property of the capacitive electrodes of a pair is indicative of a change in compression of the airbag assembly.

In Example 24, the subject matter of Examples 12-23 includes, wherein the circuit board is a flexible circuit board and wherein the flexible circuit board forms through holes, and wherein forming the seal includes bonding the first and second sheets to one another through the through holes.

In Example 25, the subject matter of Example 24 includes, forming a fold in each of the first and second sheets proximate the through holes at an edge of the first and second sheets, and wherein the electrical conductors disposed on the first and second sheets wrap around the fold to come into electrical contact with the electrical conductors on the electronic assembly.

In Example 26, the subject matter of Example 25 includes, wherein the electronic assembly extends between the first and second sheets, and wherein forming the seal is between the first and second sheets past the extent of the electronic assembly.

In Example 27, the subject matter of Example 26 includes, wherein forming the seal includes forming a weld.

In Example 28, the subject matter of Examples 19-27 includes, wherein disposing the electrical conductors includes disposing the electrical conductors on an interior surface of an associated one of the first and second sheets and further comprising: disposing capacitive electrodes on the interior surface of the first and second sheets, the capacitive electrodes electrically coupled to associated electrical conductors disposed on the first and second sheets.

In Example 29, the subject matter of Example 28 includes, wherein forming the seal includes placing the electrical conductors of the electronic assembly on the external portion.

In Example 30, the subject matter of Examples 28-29 includes, wherein forming the seal includes placing active electronics configured to receive signals from the capacitive electrodes in the interior portion.

In Example 31, the subject matter of Example 30 includes, wherein the active electronics are configured to process the signals received from the capacitive electrodes and identify a condition of the airbag based on the signals.

In Example 32, the subject matter of Examples 30-31 includes, wherein the active electronics are configured to transmit the signals to a remote device.

In Example 33, the subject matter of Example 32 includes, wherein forming the seal includes disposing the electronic assembly completely within the airbag assembly.

In Example 34, the subject matter of Example 33 includes, wherein the electronic assembly includes active electronics configured to receive signals from the capacitive electrodes.

In Example 35, the subject matter of Example 34 includes, wherein the electronic assembly includes active electronics configured to receive signals from the capacitive electrodes.

In Example 36, the subject matter of Example 35 includes, wherein the active electronics are configured to wirelessly transmit data indicative of the signals to a remote device.

Example 37 is a system comprising the article of footwear of any one or more of Examples 1-18 and a remote device.

Example 38 is the airbag assembly of any one or more of Examples 1-18.

Example 39 is a method of making the airbag assembly as described in any one or more of Examples 19-36.

Example 40 is a method of using the article of footwear of any one or more of Examples 1-18 or the system of Example 37.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

Certain embodiments are described herein as including logic or a number of components, modules, or mechanisms. Modules may constitute either software modules (e.g., code embodied on a machine-readable medium or in a transmission signal) or hardware modules. A "hardware module" is a tangible unit capable of performing certain operations and may be configured or arranged in a certain physical manner. In various example embodiments, one or more computer systems (e.g., a standalone computer system, a client computer system, or a server computer system) or one or more hardware modules of a computer system (e.g., a processor or a group of processors) may be configured by software (e.g., an application or application portion) as a hardware module that operates to perform certain operations as described herein.

In some embodiments, a hardware module may be implemented mechanically, electronically, or any suitable combination thereof. For example, a hardware module may include dedicated circuitry or logic that is permanently configured to perform certain operations. For example, a hardware module may be a special-purpose processor, such as a field programmable gate array (FPGA) or an ASIC. A hardware module may also include programmable logic or circuitry that is temporarily configured by software to perform certain operations. For example, a hardware module may include software encompassed within a general-purpose processor or other programmable processor. It will be appreciated that the decision to implement a hardware module mechanically, in dedicated and permanently configured circuitry, or in temporarily configured circuitry (e.g., configured by software) may be driven by cost and time considerations.

Accordingly, the phrase "hardware module" should be understood to encompass a tangible entity, be that an entity that is physically constructed, permanently configured (e.g., hardwired), or temporarily configured (e.g., programmed) to operate in a certain manner or to perform certain operations described herein. As used herein, "hardware-implemented module" refers to a hardware module. Considering embodiments in which hardware modules are temporarily configured (e.g., programmed), each of the hardware modules need not be configured or instantiated at any one instance in time. For example, where a hardware module comprises a general-purpose processor configured by software to become a special-purpose processor, the general-purpose processor may be configured as respectively different special-purpose processors (e.g., comprising different hardware modules) at different times. Software may accordingly configure a processor, for example, to constitute a particular hardware module at one instance of time and to constitute a different hardware module at a different instance of time.

Hardware modules can provide information to, and receive information from, other hardware modules. Accordingly, the described hardware modules may be regarded as being communicatively coupled. Where multiple hardware modules exist contemporaneously, communications may be achieved through signal transmission (e.g., over appropriate circuits and buses) between or among two or more of the hardware modules. In embodiments in which multiple hardware modules are configured or instantiated at different times, communications between such hardware modules may be achieved, for example, through the storage and retrieval of information in memory structures to which the multiple hardware modules have access. For example, one hardware module may perform an operation and store the output of that operation in a memory device to which it is communicatively coupled. A further hardware module may then, at a later time, access the memory device to retrieve and process the stored output. Hardware modules may also initiate communications with input or output devices, and can operate on a resource (e.g., a collection of information).

The various operations of example methods described herein may be performed, at least partially, by one or more processors that are temporarily configured (e.g., by software) or permanently configured to perform the relevant operations. Whether temporarily or permanently configured, such processors may constitute processor-implemented modules that operate to perform one or more operations or functions described herein. As used herein, "processor-implemented module" refers to a hardware module implemented using one or more processors.

Similarly, the methods described herein may be at least partially processor-implemented, a processor being an example of hardware. For example, at least some of the operations of a method may be performed by one or more processors or processor-implemented modules. Moreover, the one or more processors may also operate to support performance of the relevant operations in a "cloud computing" environment or as a "software as a service" (SaaS). For example, at least some of the operations may be performed by a group of computers (as examples of machines including processors), with these operations being accessible via a network (e.g., the Internet) and via one or more appropriate interfaces (e.g., an application program interface (API)).

The performance of certain of the operations may be distributed among the one or more processors, not only residing within a single machine, but deployed across a number of machines. In some example embodiments, the one or more processors or processor-implemented modules may be located in a single geographic location (e.g., within a home environment, an office environment, or a server farm). In other example embodiments, the one or more processors or processor-implemented modules may be distributed across a number of geographic locations.

Some portions of this specification are presented in terms of algorithms or symbolic representations of operations on data stored as bits or binary digital signals within a machine memory (e.g., a computer memory). These algorithms or symbolic representations are examples of techniques used by those of ordinary skill in the data processing arts to convey the substance of their work to others skilled in the art. As used herein, an "algorithm" is a self-consistent sequence of operations or similar processing leading to a desired result. In this context, algorithms and operations involve physical manipulation of physical quantities. Typically, but not necessarily, such quantities may take the form of electrical, magnetic, or optical signals capable of being stored, accessed, transferred, combined, compared, or otherwise manipulated by a machine. It is convenient at times, principally for reasons of common usage, to refer to such signals using words such as "data," "content," "bits," "values," "elements," "symbols," "characters," "terms," "numbers," "numerals," or the like. These words, however, are merely convenient labels and are to be associated with appropriate physical quantities.

Unless specifically stated otherwise, discussions herein using words such as "processing," "computing," "calculating," "determining," "presenting," "displaying," or the like may refer to actions or processes of a machine (e.g., a computer) that manipulates or transforms data represented as physical (e.g., electronic, magnetic, or optical) quantities within one or more memories (e.g., volatile memory, non-volatile memory, or any suitable combination thereof), registers, or other machine components that receive, store, transmit, or display information. Furthermore, unless specifically stated otherwise, the terms "a" or "an" are herein used, as is common in patent documents, to include one or more than one instance. Finally, as used herein, the conjunction "or" refers to a non-exclusive "or," unless specifically stated otherwise.

What is claimed is:

1. An article of footwear, comprising:

an upper portion;

a lower portion, secured to the upper portion, including an out-sole and an airbag assembly, wherein the airbag assembly comprises:

a first sheet and a second sheet forming a seal therebetween around a perimeter of the first and second sheets;

an electronic assembly, comprising a circuit board and electrical conductors disposed on the circuit board, wherein an internal portion of the electronic assembly is disposed between the first and second sheets and within the seal formed therebetween and an external portion of the electronic assembly is disposed outside of the seal;

wherein the airbag assembly further comprises electrical conductors disposed on at least one of the first sheet or the second sheet, the electrical conductors disposed on the circuit board electrically coupled to an associated one of the electrical conductors disposed on the first or second sheet;

wherein the electrical conductors disposed on the at least one of the first sheet or the second sheet are disposed on an exterior surface of an associated one of the first and second sheets;

wherein the circuit board is a flexible circuit board and wherein the flexible circuit board forms through holes, and wherein the first and second sheets are bonded to one another through the through holes; and wherein the first and second sheets each form a fold proximate the through holes at an edge of the first and second sheets, and wherein the electrical conductors disposed on the first and second sheets wrap around the fold to come into electrical contact with the electrical conductors on the electronic assembly.

2. The article of footwear of claim 1, wherein the airbag assembly further comprises capacitive electrodes disposed on the exterior surface of the first and second sheets and electrically coupled to the electrical conductors disposed on the first and second sheets and to the electrical conductors on the circuit board.

3. The article of footwear of claim 2, wherein the capacitive electrodes form capacitive electrode pairs, one capacitive electrode of each pair on the first sheet and the other capacitive electrode of each pair on the second sheet opposed to the other electrode of the pair, wherein a change in an electrical property of the capacitive electrodes of a pair is indicative of a change in compression of the airbag assembly.

4. The article of footwear of claim 1, wherein the electronic assembly extends between the first and second sheets, and wherein the seal is formed between the first and second sheets past the extent of the electronic assembly.

5. The article of footwear of claim 4, wherein the seal is a weld.

6. The article of footwear of claim 1, wherein the electrical conductors are disposed on an interior surface of an associated one of the first and second sheets and further comprising capacitive electrodes disposed on the interior surface of the first and second sheets, the capacitive electrodes electrically coupled to associated electrical conductors disposed on the first and second sheets.

* * * * *